US007861639B1

(12) United States Patent
Trybulski et al.

(10) Patent No.: US 7,861,639 B1
(45) Date of Patent: Jan. 4, 2011

(54) ARTILLERY PROJECTILE EXTRACTOR

(75) Inventors: Mark Trybulski, Hopatcong, NJ (US); Diep Ho, Yuma, AZ (US); Brian McAbee, Portland, PA (US); Michael Hollis, Flanders, NJ (US); Donald Carlucci, Sparta, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 82 days.

(21) Appl. No.: 12/496,741

(22) Filed: Jul. 2, 2009

Related U.S. Application Data

(60) Provisional application No. 61/122,790, filed on Dec. 16, 2008.

(51) Int. Cl.
*F41A 9/00* (2006.01)

(52) U.S. Cl. ..... 89/47; 89/1.1; 89/45

(58) Field of Classification Search ..... 89/1.1, 89/45, 47
See application file for complete search history.

(56) References Cited

U.S. PATENT DOCUMENTS

| | | | | | |
|---|---|---|---|---|---|
| 33,513 | A * | 10/1861 | Bogia | ..... | 89/47 |
| 37,364 | A * | 1/1863 | Stevens | ..... | 89/46 |
| 102,214 | A * | 4/1870 | Brewer | ..... | 89/47 |
| 311,974 | A * | 2/1885 | Gatling | ..... | 89/45 |
| 932,094 | A * | 8/1909 | Becker | ..... | 89/47 |
| 4,735,307 | A * | 4/1988 | Freeman | ..... | 206/3 |
| 5,404,666 | A * | 4/1995 | Cline, Jr. | ..... | 42/90 |
| 5,651,207 | A * | 7/1997 | Knight | ..... | 42/95 |
| 7,650,827 | B1 * | 1/2010 | Spooner, Jr. | ..... | 89/47 |
| 2007/0294930 | A1 * | 12/2007 | Mays | ..... | 42/95 |

* cited by examiner

*Primary Examiner*—Troy Chambers
(74) *Attorney, Agent, or Firm*—Henry S. Goldfine

(57) ABSTRACT

A hand operated projectile extractor to remove unspent projectiles from 155 mm howitzers, which extractor is generally cylindrical, about 18 inches in length, with a handle extending from the rear thereof and with an overall weight of at least about 30 pounds, to provide enough momentum to eject the projectile. When rammed into the muzzle of a howitzer and down the barrel thereof, the ogive of the projectile enters the open front of the extractor's cylindrical body and will be impacted by a compression ring along the extractor's front edge, which compression ring has a minimum internal diameter of 4.75 inches and is formed of particular flat and curved surfaces which will not bind to either the projectile or the barrel.

8 Claims, 5 Drawing Sheets

ARTILLERY PROJECTILE EXTRACTOR

CROSS REFERENCE TO RELATED APPLICATIONS

This application claims priority of U.S. Provisional Application No. 61/122,790, filed Dec. 16, 2008, which is hereby incorporated herein by reference.

STATEMENT REGARDING FEDERALLY SPONSORED RESEARCH OR DEVELOPMENT

The invention described herein may be made, used, or licensed by or for the United States Government for Government purposes without the payment of any royalties thereon or therefore.

BACKGROUND OF THE INVENTION

1. Field of the Invention

The present invention relates to an artillery projectile extractor, and more specifically to a hand operated projectile extractor capable of extracting any projectile from a howitzer without jamming or damaging the projectile.

2. Description of Related Art

Modern artillery projectiles, such as the Excalibur XM982, that are capable of self-guidance to a predetermined target, can be very expensive, i.e. costing over $80,000 per projectile. In the past, if such a projectile had to be removed unfired from a 155 mm howitzer, such as the M198 howitzer, an extractor, such as shown in FIG. 1 herein, would have been inserted into the muzzle of the howitzer's barrel, to force the projectile back out of the howitzer's breech. Due to the relatively light weight of such prior extractors, approximately 11 pounds, insufficient momentum could be generated by hand to force the projectile from the breech—such that a sledgehammer would be used to hit the handle, or a vehicle backed against the handle, to generate enough force to eject the projectile. Further, the prior extractor would occasionally bind to the projectile, forcing use of mechanical means to extract the projectile and extractor from the barrel, further wasting time. More troubling than the time and effort of lowering the barrel and using a vehicle, or the occasional binding, was the fact that the configuration of the portion of the extractor that impacted the projectile was such as to damaged the sensitive guidance components within the head of the projectile, such that the projectile would have to be discarded, a total loss.

Clearly there was a need in the art for an extractor capable of generating the momentum to remove an unfired projectile, without any binding, and without any damage to the projectile.

SUMMARY OF THE INVENTION

Objectives of the present invention are to provide a projectile extractor for field artillery that provides sufficient momentum to allow the projectile to be extracted through the howitzer's breech using only hand operation, without any damage to the projectile, and without the extractor itself jamming by binding to the projectile.

The projectile extractor of the present invention as detailed herein can be utilized to extract unfired projectiles from the barrel of 155 mm howitzers, it being understood that for use with other caliber field artillery the dimensions of the extractor would have to be appropriately proportioned. For such use with a 155 mm howitzer, the subject extractor has a generally cylindrical, seamless body about 18 inches in length, preferably 18+/−2 inches in length, with an elongated handle extending perpendicularly from the center of its closed rear end. For a 155 mm/39 caliber howitzer, with a barrel length of approximately 20 feet, the elongated handle should be at least about 23 feet in length, to allow adequate length for easy manipulation of the portion of the handle that will remain exterior to the barrel.

The extractor body has a compression ring along its front edge, such that when the extractor is rammed through the muzzle of the howitzer and down the barrel, the ogive section of the projectile enters the cylindrical body section of the extractor, passing through this compression ring, and thereby impacts the interior of the compression ring along its internal diameter, which is critically at least about 4.75 inches (to avoid impacting and crushing sensing electronics disposed about the ogive of modern projectiles). The configuration of the compression ring is critical to avoid binding, whereby it has a first flat surface, extending from the interior of the cylindrical body of the extractor for a distance of about 5/16 inch, at an angle of about 60 degrees therefrom, at which point this first flat intersects a first curved surface described by a 1.0 inch radius. The 1.0 inch radius surface extends from this intersection with the first flat to generally to the most forward point of the compression ring, i.e. about 6/16 inches from the front-most portion of the cylindrical body, where it intersects a second curved surface described by a smaller, 0.5 inch radius, which second curved surface extends approximately to the exterior diameter of the compression ring, where it intersects a second flat surface, which is generally perpendicular to and extending forward away from the front of the cylindrical body section. The particular flats and curved surfaces are critical, in that use of other, proportionally larger/small radii have been found to bind the extractor. Further, the exterior diameter of the projectile extractor is about 6 inches, such that there is sufficient clearance from the 6.1 inches interior diameter of the 155 mm howitzer's barrel. And, there are two larger diameter exterior cylindrical sections, one near the front and one near the back of the cylindrical body, that act as bourrelets—to bear upon the lands of the barrels rifling, and thereby better center the projectile extractor in the barrel as the extractor is guided down the barrel and rammed against the projectile, thereby forcing the projectile out of the breech of the howitzer.

The total weight of the subject inventive extractor should be at least about 30 pounds, preferably about 33 pounds, to ensure that sufficient momentum is generated to eject the projectile from the howitzer when using the extractor by hand. To obtain such a weight, to ensure that the body section does not fail prematurely, and to reduce cost, it is preferred that the body section be manufactured of carbon steel having a minimum yield strength of 32 KSI, a minimum tensile strength of 50 KSI, a minimum elongation of 25%, a minimum hardness of 55 Rockwell B. However, the compression ring, which must not damage the projectile and which must bear repeated impact against the projectile, should preferably be manufactured of 4140 steel, that complies with ASTM Standard A519 or A322, i.e. heat treated, ausenitized, quenched, and tempered to 46 to 50 HRC. Preferably, the entire projectile extractor should be treated with a protective phosphate coating, per IAW 5.1.1, which is described in MIL-STD-171. The elongated handle can be preferably manufactured of a relatively light weight metal, preferably aluminum, to reduce cost, while providing the desired overall mass (to generate the momentum necessary to extract the subject projectile); and, to provide the structural integrity, i.e. strength, to withstand the repeated blows, which occur when used multiple times to extract unspent projectiles.

The other objects, features and advantages of the present invention will become more apparent in light of the figures contained herein and the following detailed description thereof.

DETAILED DESCRIPTION OF THE INVENTION

Figure 1:
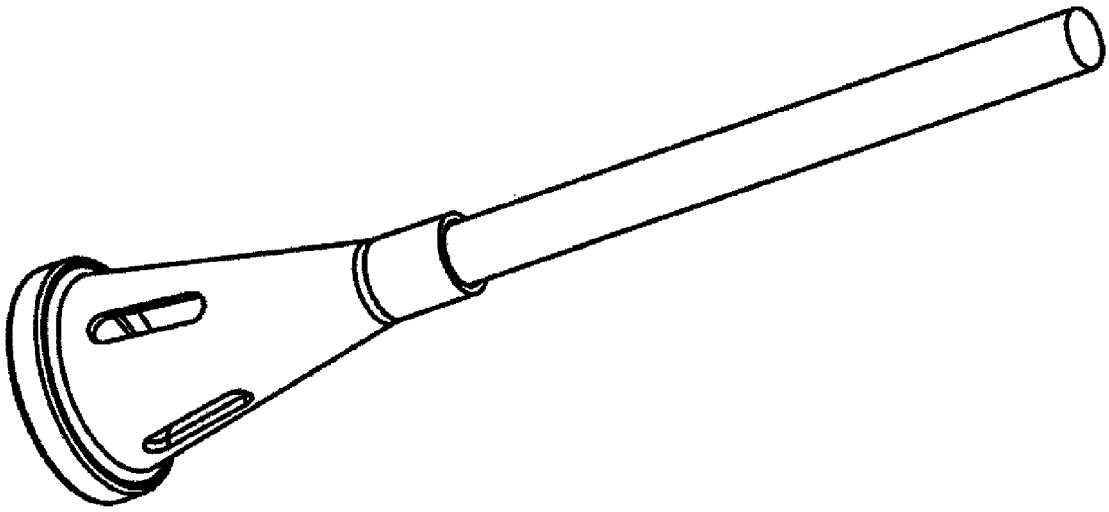
Fig. 1 PRIOR ART
FIG. 1 is an isometric view of a projectile extractor of the prior art.
Figure 2:
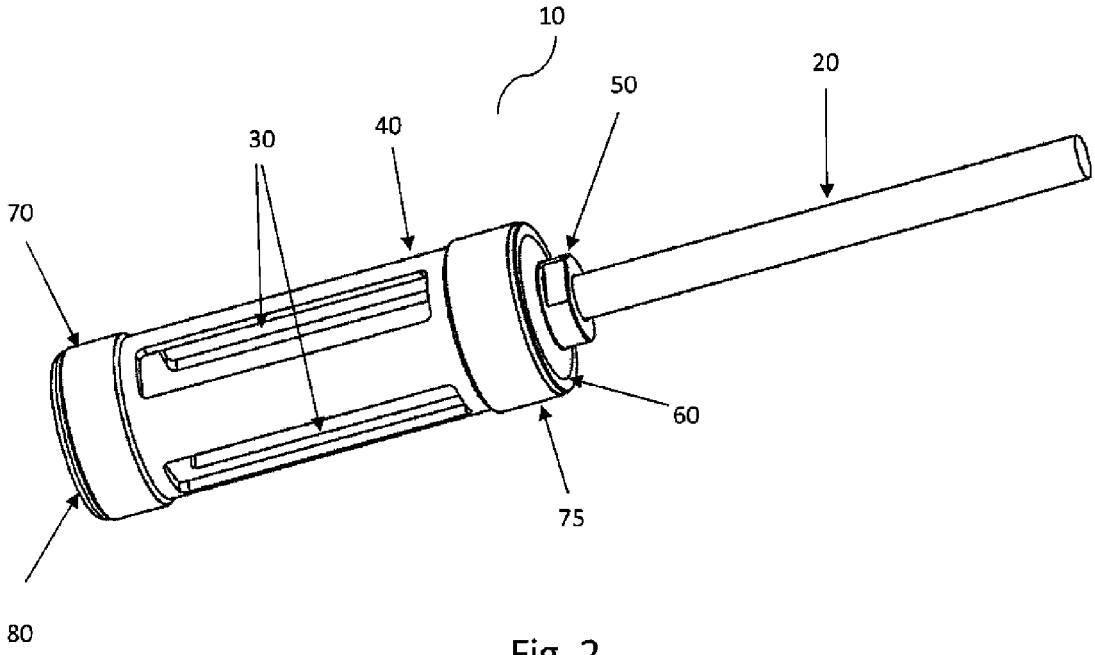
FIG. 2 is an isometric view of a projectile extractor of the present invention.
Figure 3:
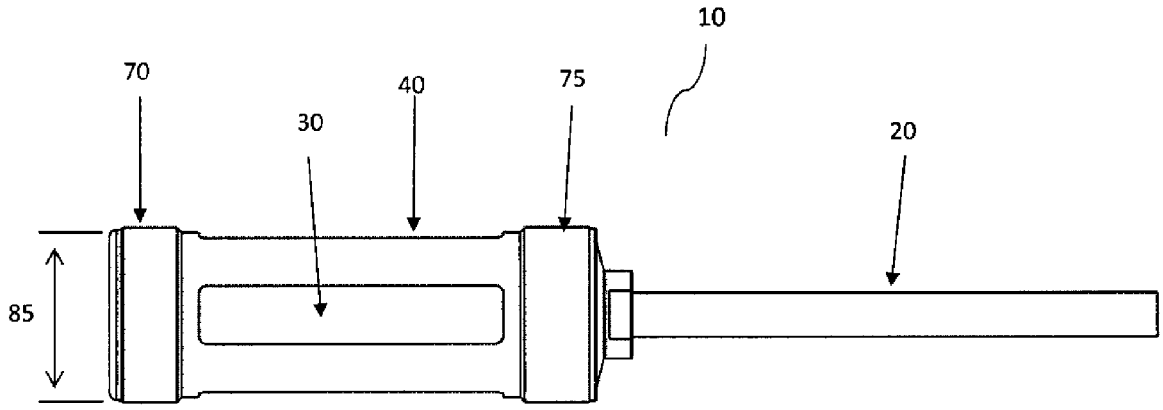
FIG. 3 is a side view showing a projectile extractor of the present invention.
Figure 4:
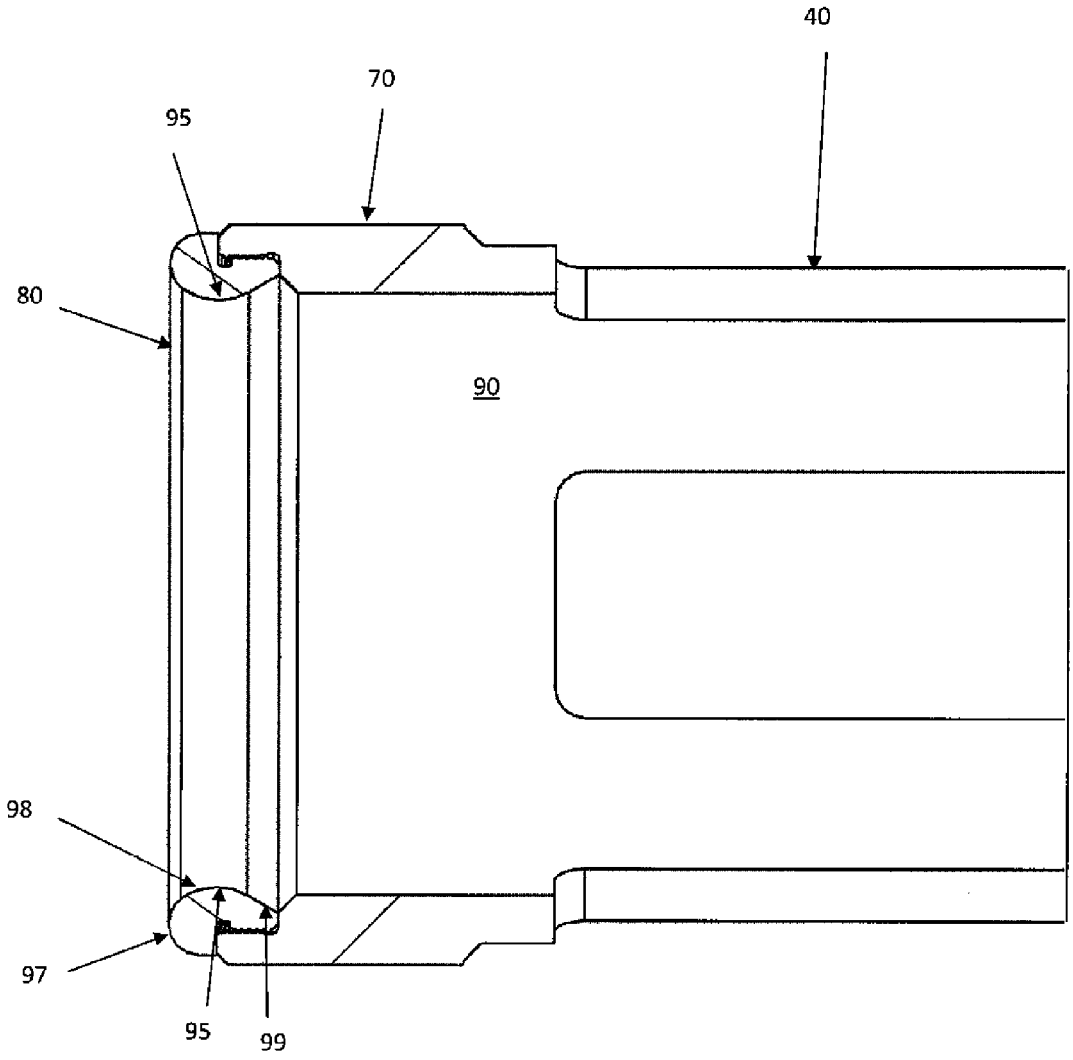
FIG. 4 is a cross-section of the front section of a projectile extractor of the present invention, to highlight the compression ring located at the very front.

FIG. 2 shows an isometric view of a projectile extractor 10 of the present invention as designed for extraction of unspent projectiles from 155 mm/39 caliber howitzers, which extractor is formed of a generally seamless, cylindrical body 40, preferably of carbon steel, about 18 inches in length, preferably 18+/−2 inches in length; with an elongated handle 20, at least about 25 feet in length, preferably 30 feet in length, extending from its rear; and with a compression ring 80 along its front edge, preferably of steel; wherein the ogive section of the projectile, i.e. its nose section (not shown), enters the interior of the body section 40, through open front end and through the compression ring 80 thereabout, to impact the interior of the compression ring along its interior diameter 85, which is critically at least about 4.75 inches (to avoid impacting and crushing sensing electronics disposed about the ogive of the projectile). The interior of the compression ring 80 is formed of a first flat surface, flat 1, extending from the interior of the extractor at an angle of about 60 degrees from the cylindrical surface thereof for a distance of approximately 5/16 inch, at which point this first flat surface intersects a first curved surface described by a 1.0 inch radius, R1, this first curved surface extends from this intersection to the foremost point of the compression ring, about 6/16 inches from the front of the cylindrical body. The exterior surface of the compression ring is formed of a second flat, Flat 2, generally perpendicular and extending forward away from the front of the cylindrical body section, which second flat, Flat 2, intersects a second curved surface, described by a 0.5 inch radius, R2, which connects the second flat and the first curved surface, R1, meeting the first radius at the most forward point of the compression ring, i.e. the most forward point of the projectile extractor. These particular dimensions of the compression ring are critical, in that use of other radii, has led to binding of the extractor. Further, the exterior diameter 85 of the projectile extractor is about 6 inches, such that there is sufficient clearance from the 6.1 inches interior diameter of the 155 mm howitzer's barrel. And, there are two larger diameter exterior cylindrical sections, one near the compression ring at the front of the extractor, a forward bourrelet 70 and one near the handle of the extractor, i.e. the rear of the cylindrical body, a rear bourrelet 75—which bourrelets, in combination, bear upon the lands of the barrels rifling, and thereby better center the projectile extractor 10 in the barrel, as it is rammed down the howitzer's barrel and against the projectile to force the projectile out of the breech of the howitzer.

As stated above, for a 155 mm/39 caliber howitzer, with a barrel length of approximately 20 feet, the elongated handle 20 should be at least about 23 feet in length, to allow adequate length for easy manipulation of the portion of the handle that will remain exterior to the barrel. For easy transportation, due to the extended length of the handle, the handle can be manufactured in relatively short, threaded sections that are easily screwed into each other. It is preferred that the handle sections be about 3.3 feet in length, i.e. about 1 meter, in length, such that with 7 sections the overall length of the handle will be the preferred, about 23 feet total length.

As shown in FIG. 2, a series of rectangular cut-outs 30, wherein the long side of the rectangular cut-outs are generally parallel, i.e. aligned with, the longitudinal axis of the cylindrical body 40 of the present invention. These cut-outs 30 help obtain the overall weight of the subject projectile extractor 10 to the desired at least about 30 pounds, and preferably about 33 pounds (but, not much more—as any greater weight will negatively impact the maneuverability of the extractor). Further, these rectangular cut-outs 30 provide hand holds, to facilitate easy grasping and manipulation of the subject present invention—which as can be imagined, with about a 23 foot handle, can be ungainly. It is preferred that there be at least 2 such rectangular cut-outs, preferably 3, and most preferably 4.

Figure 5:
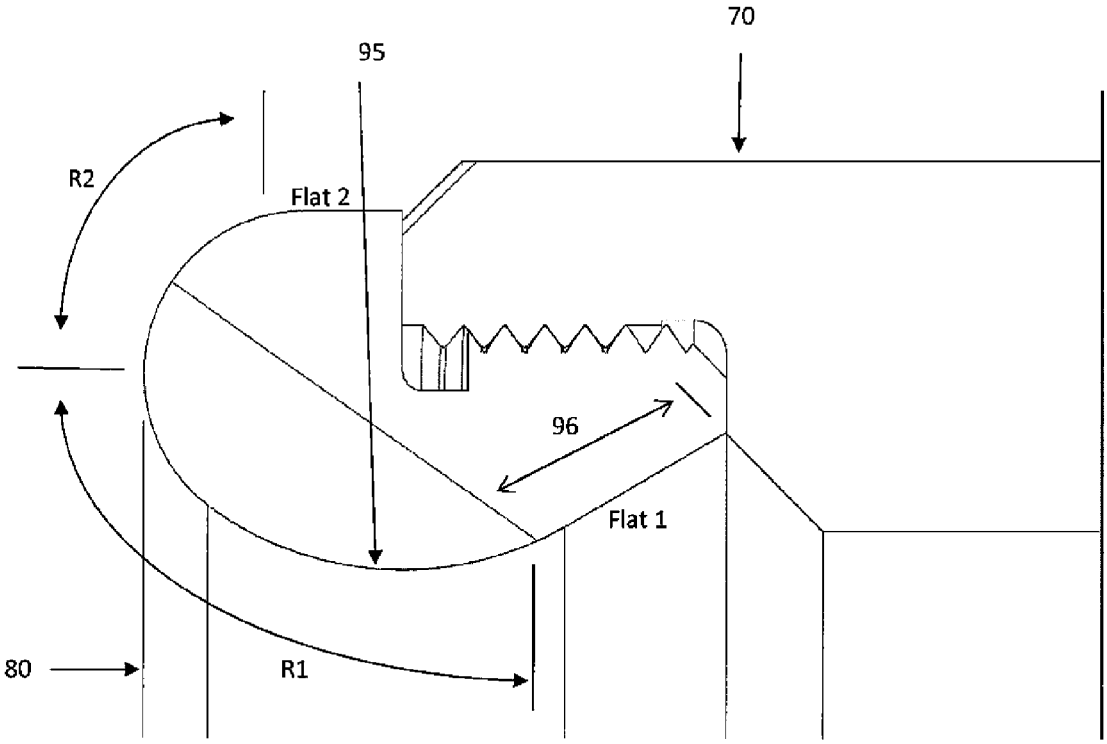
FIG. 5 is an enlarged section of one end of the front section of a projectile extractor of the present invention, to highlight the configuration of the compression ring.

In order to provide easy assembly and disassembly of the subject projectile extractor invention, the various parts are held together using screw fastenings; such as described above, with respect to the handle sections. More specifically, referring to FIG. 2, the entire handle extending from the rear, 20, is held by threads within a rear section 50; which rear section 50 can be formed integrally with a rear plug 60, or threaded to the rear plug 60; which rear plug 60 is held by threads to the cylindrical body 40. As shown in FIG. 5, the compression ring 80, is screw threaded into the interior of the cylindrical body 40; which cylindrical body 40, is preferably cast as an integral, seamless work piece.

As stated above, the subject projectile extractor 10, composed essentially of the cylindrical body section 40, joining plug 50, and joined elongated handle 20 should have a weight of at least about 30 pounds, and preferably about 33 pounds, to ensure that sufficient momentum is generated to eject the projectile from the howitzer by hand. Further, to ensure that the body section 40 does not fail prematurely, it is preferably manufactured of carbon steel having a minimum yield strength of 32 KSI, a minimum tensile strength of 50 KSI, a minimum elongation of 25%, a minimum hardness of 55 Rockwell B; or, manufactured to ASTM A519 grade, 1018 or 1020 hot rolled condition. The steel compression ring, that will bear repeated impact against the projectile, should preferably be manufactured of 4140 steel, that complies with ASTM Standard A519 or A322, i.e. heat treated, ausenitized, quenched, and tempered to 46 to 50 HRC. The surface of the compression ring is preferably treated with a protective phosphate coating, per IAW 5.1.1, which is described in MIL-STD-171.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A hand operated projectile ejector for engaging with the ogive of an unspent projectile within the barrel of a 155 mm howitzer and forcing the projectile out the breech of the howitzer, the projectile ejector comprising:

a generally cylindrical body section having a compression ring disposed about the edge of the open front end thereof and having a closed back end, opposed to the open front end thereof;

said compression ring having a minimum interior diameter of about at least about 4.75 inches;

said generally cylindrical body section being about 18 inches in length;

an elongated handle extending generally central to and perpendicularly to said closed back end in the direction away from said generally cylindrical body;

said compression ring having a first flat surface extending from the interior of the generally cylindrical body at an angle of 60 degrees therefrom, for a distance of about 5/16 of an inch, at which point this first flat surface intersects a first curved surface described by a 1.0 inch radius, which first curved surface extends to the point of the compression ring furthest from said cylindrical body, where it intersects a second curved surface described by a 0.5 inch radius, which second curved surface extends to approximately the exterior diameter of the compression ring, where it intersects a second flat surface, which second flat surface is generally perpendicular and extending forward, away from the front of the cylindrical body section;

wherein, when the projectile extractor is rammed through the muzzle of the howitzer and down the barrel thereof, the ogive of the projectile will enter the body section of the projectile extractor through the open front end and will be impacted the compression ring along the interior diameter thereof; and wherein the exterior diameter of the generally cylindrical body is about 6 inches.

2. The projectile extractor of claim 1, wherein there are at least 2 rectangular cut-outs through the generally cylindrical body, the long side of which rectangular cut-outs are aligned with the longitudinal axis of said cylindrical body.

3. The projectile extractor of claim 1, wherein toward the front and toward the rear of the generally cylindrical body section, there are two larger diameter exterior cylindrical sections, which sections act as bourrelets to bear upon the lands of the barrels rifling.

4. The projectile extractor of claim 1, wherein the compression ring is manufacture of steel.

5. The projectile extractor of claim 1, wherein the generally cylindrical body is manufactured of carbon steel.

6. The projectile extractor of claim 1, wherein the handle thereof is aluminum.

7. The projectile extractor of claim 1, wherein the handle thereof is about 23 feet in length.

8. The projectile extractor of claim 1, wherein the cylindrical body section has an outside diameter of 6 inches.

* * * * *